United States Patent [19]

Stude

[11] Patent Number: 4,507,869

[45] Date of Patent: Apr. 2, 1985

[54] MARKER ATTACHMENT FOR RULES

[76] Inventor: Michael E. Stude, 1020 S. Grove La., Barrington, Ill.

[21] Appl. No.: 484,974

[22] Filed: Apr. 14, 1983

[51] Int. Cl.[3] ..... B43L 13/02

[52] U.S. Cl. ..... 33/42; 33/138; 33/189; 33/167; 33/485

[58] Field of Search ..... 33/42, 27 C, 138, 189, 33/484, 485, 486, 167

[56] References Cited

U.S. PATENT DOCUMENTS

| | | | |
|---|---|---|---|
| 1,168,362 | 1/1916 | Wood | 33/173 X |
| 1,248,148 | 11/1917 | Milliken | 33/27 C |
| 1,394,992 | 10/1921 | Fry | 33/42 |
| 1,988,095 | 1/1935 | Stockman | 33/27 C |
| 2,026,768 | 1/1936 | Aronson | 33/27 C |
| 3,871,100 | 3/1975 | Hildebrandt | 33/42 |

*Primary Examiner*—William D. Martin, Jr.

*Attorney, Agent, or Firm*—Lockwood, Alex, FitzGibbon & Cummings

[57] ABSTRACT

A marker attachment for an elongated rule, such as a metal measuring tape adapted to be stored in compact coiled condition in a case from which it is extendible and into which it is retractable. The marker attachment has at least one integrally formed projection with a pencil-point receiving hole therein. Preferably, the attachment is integrally formed from flexible, but relatively stiff, plastic sheet material and in use slideably embraces a rule or tape. Also, it is preferred for the attachment to have an integral pointer which is aligned with the pencil-point receiving hole in a direction transverse to the rule and registrable with rule markings. In addition, it is preferred to provide the attachment with a piece of friction material which will engage the rule and tend to retain the attachment in place when moved to a desired position on the rule.

8 Claims, 14 Drawing Figures

MARKER ATTACHMENT FOR RULES

My invention relates to an inexpensive, handy-to-use, marker attachment for use with elongated rules and measuring tapes whereby with the use of a pencil a line may be readily drawn parallel to the edge of a work piece at a predetermined distance inwardly of the edge. For example, there is often a need to separate a piece of plywood or drywall from a larger sheet or panel. Specifically, it may be desired to cut off a two-foot wide piece of sheet rock or plywood from a four-by-eight panel. By means of the marker attachment of the present invention, a workman's rule or tape measure can be readily used so as to draw a straight line inwardly two feet (or other desired distance) from one of the edges of the panel.

The marker attachments of my invention are formed from flexible plastic sheet material having a substantial degree of stiffness. They can be mass-produced at low cost by stamping from plastic sheet stock using suitable stamping dies and equipment. Certain embodiments of the invention may desirably be formed by plastic injection molding so as to have greater rigidity. If desired, my marker attachment can be formed from sheet metal, such as enameled tin plate or aluminum sheet stock.

The marker attachments of my present invention are sufficiently inexpensive so that they can be used as give-away promotion items with advertising printed thereon. For example, a lumber yard or material supply store could very well obtain a large supply of the attachments at low unit cost and hand the same out gratis to customers.

I am aware that devices have been previously proposed for generally the same purpose, one being disclosed in U.S. Pat. No. 2,763,065 and another in U.S. Pat. No. 3,336,678. However, my marker attachment offers a number of advantages over these previous devices.

The object of my invention, generally stated, is the provision of an inexpensive marker attachment for use with an elongated rule such as a coiled, metal measuring tape so as to provide a handy means whereby with the use of a pencil, a carpenter or workman can draw a line on a work piece parallel to a straight edge thereof at a desired distance from the edge.

Additional and more specific objects of the invention will be apparent from the following detailed description of preferred embodiments of the invention.

For a more complete understanding of the nature and scope of the invention, reference may now be had to the following detailed description thereof taken in connection with the accompanying drawings wherein.

Figure 2:
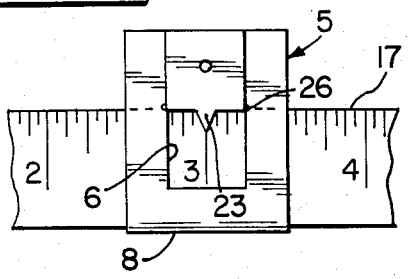
FIG. 2 is a view showing the marker attachment of FIG. 1 in place on an elongated rule in the form of a steel tape.

Referring to FIGS. 1, 2, 13 and 14, a marker attachment is indicated generally at 5 which is formed of relatively stiff, plastic sheet stock having a thickness of about one/thirty-seconds of an inch. Various known commercial plastic materials may be used such as a polyolefin (e.g. polyethylene or polypropylene), a polyester (e.g. nylon or an acrylate), a co-polymer (e.g. butadiene-styrene co-polymers), or blends of the foregoing. The marker 5 is formed from a rectangular piece of the plastic sheet stock measuring one inch by three and five-sixteenths inches. This rectangular piece may be die-stamped from a single sheet or stack of sheets in well-known manner. Preferably, at the time of stamping or die-cutting, a rectangular window opening 6 is formed with complete removal of the material while in another portion a tab 7 is die-cut by severing the material on three sides only. After being thus formed in the flat condition, the rectangular piece is permanently creased at crease lines 8 and 10 so as to have a middle panel 11, a first end panel 12, and a second somewhat longer end panel 13. Preferably, a piece of sponge rubber or other resilient material 14 is cemented against the inner face of the middle panel 11 so as to have frictional engagement with a rule as will be described more fully in connection with FIGS. 13 and 14.

At the time of die-cutting or stamping the marker attachment 5, two pencil-point receiving holes 15 and 16 are formed in the tab 7 and outer end of the panel 13, respectively. In addition, it is desirable at the time of production to form an integral V-pointer 23 in the panel 11 hinged at the crease line 10.

Figure 13:
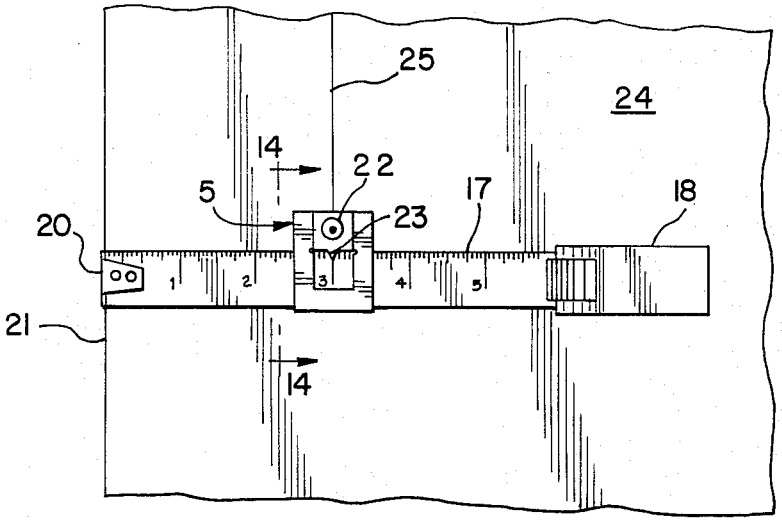
FIG. 13 is a view illustrating the manner in which the marker attachment of FIGS. 1 and 2 is used.
Figure 10:
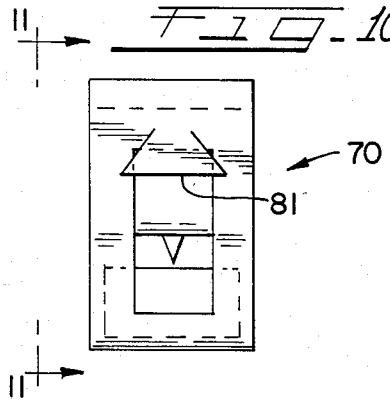
FIG. 10 is a view of the embodiment of FIG. 9 in a closed position.
Figure 14:
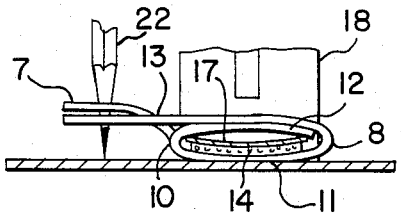
FIG. 14 is an enlarged view taken on lines 14—14 of FIG. 13.
Figure 9:
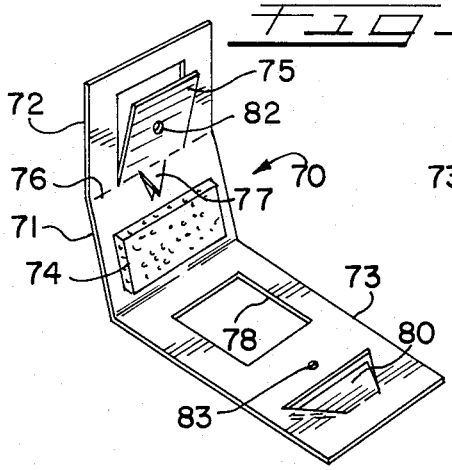
FIG. 9 is a perspective view of a fifth embodiment of the invention in partially folded condition.
Figure 11:
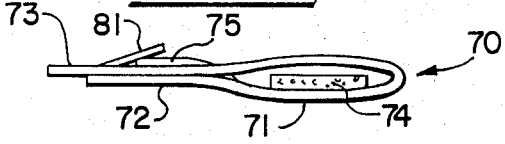
FIG. 11 is an edge view taken on line 11—11 of Fig. 10.

Reference may now be had to FIGS. 2, 13 and 14 for a description as to how the marker attachment 5 is used in connection with an elongated rule indicated at 17. The rule 17 may be a conventional steel measuring tape of the well-known type that is stored in tightly coiled condition in a case 18 from which it may be withdrawn and returned as needed. The outer or free end of the rule 17 is provided with the usual right-angle hook member 20 so that the end may be hooked over or caught on an edge or a work piece such as the edge 21 of a panel 24 of sheet rock or plywood.

Figure 1:
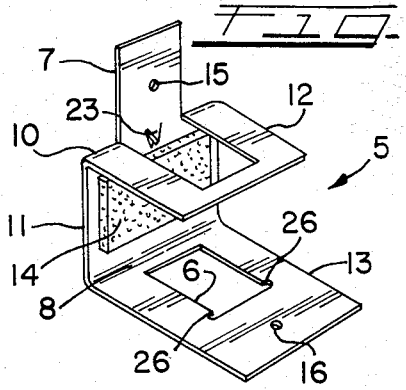
FIG. 1 is a perspective view of a marker attachment for a rule forming one embodiment of the present invention and shown in partially folded condition.

The marker attachment 5 is applied to the rule 17 from the condition shown in FIG. 1 so that the sponge rubber 14 engages the back side of the rule 17 as shown in FIG. 14. Then, the end panel 12 is folded over onto the top side or face of the rule 17 after which the end panel 13 is folded over on top of the panel 12. The tab 7 is inserted upwardly through the open window 9 and then folded over the outer end of the panel 13 bringing the pencil holes 15 and 16 into registration so as to receive the point of a pencil 22. Preferably, the window 16 is formed with a pair of notches 26—26 (FIG. 1) for receiving the tab 7 at the crease line 10. The tab 7 should be slightly wider than the window 16 so as to fit into the notches 26 and retain the attachment 5 in its closed rule-embracing condition shown in FIG. 14.

Figure 12:
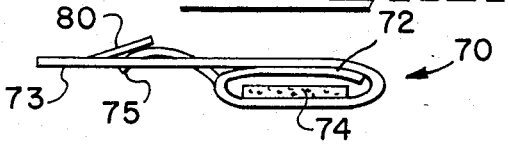
FIG. 12 is an edge view similar to FIG. 11 but showing the embodiment of FIGS. 9 and 10 applied in a different manner to a rule.

The attachment can be slid along the rule 17 so that the pencil holes 15 and 16 and pointer 23 are in registration with a desired marking on the rule e.g. the three-inch marking. With the hook 20 fitted over the edge 21 of the plywood or sheet rock panel 24 and with the point of pencil 22 in place in the holes 15 and 16 as shown in FIGS. 12 and 13, the rule 17 is moved downwardly with the hook 20 following the edge 21 and, thereby, leaving a pencil line 25 on the surface of the panel 24 which is parallel to the edge 21.

Figure 4:
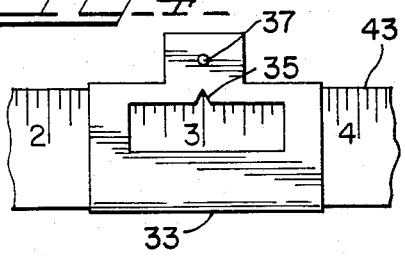
FIG. 4 is a view showing the embodiment of FIG. 3 in place on an elongated rule.
Figure 3:
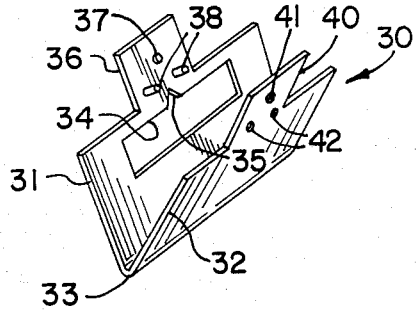
FIG. 3 is a perspective view of a second embodiment of the invention in partially folded condition.

The embodiment shown in FIGS. 3 and 4 comprises a marker attachment indicated generally at 30 which may be injection molded from plastic in the form of two panels 31 and 32 integrally hinged together at 33. The panel 31 is formed with a viewing window 34 with a V-pointer notch 35. Integrally formed on the panel 31 is a tab 36 which has a pencil-point receiving hole 37 and a pair of integral locking prongs 38. The panel 32 has a tab 40 formed thereon which is adapted to mate with the tab 36 and which also has a pencil-point receiving hole 41 therein and a pair of holes 42 for receiving the locking prongs 38 in frictional retention engagement. In use, the attachment 30 is applied over a rule 43 so that the hinge 33 engages the bottom edge of the rule or tape 43 and then the panels 31 and 32 are pressed together with the locking prongs 38 guided into locking engagement through the holes 42. The pencil-point receiving holes 37 and 41 will be in registration and in alignment with the point of the V-notch 35, as shown in FIG. 4. It will be seen that the marker attachment 40 may be manually slid along the rule 43 to any desired graduation marking and then used in the same manner as described above in connection with FIGS. 13 and 14.

Figure 5:
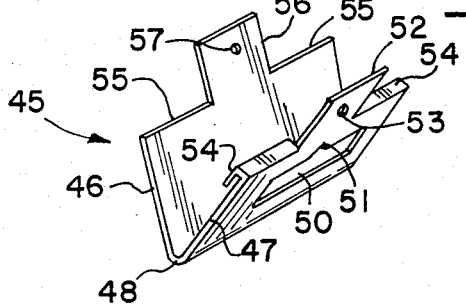
FIG. 5 is a perspective view of a third embodiment of the invention in partially folded condition.
Figure 6:
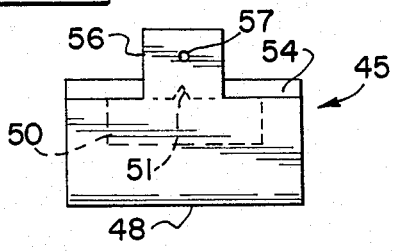
FIG. 6 is a rear elevational view of the embodiment of FIG. 5 in its closed position.

In FIGS. 5 and 6, a marker attachment is indicated generally at 45 which forms another embodiment of the invention and is generally similar to the marker attachment 30 of FIGS. 3 and 4. The marker attachment 45 may be injection molded from suitable semi-rigid material so as to have panels 46 and 47 hinged together along a hinge line 48. The panel 47 is provided with a window 50 having a V-pointer notch 51. A tab 52 projects from the panel 47 and is provided with a pencil-receiving hole 53. Integrally formed on the panel 47, on opposite sides of the tab 52, are locking hook formations 54—54 which are adapted to hook over the opposing edges 55—55 on the panel 46. The panel 46 is also provided with a tab 56 which has a pencil-point receiving hole 57 therein. It will be seen that, in use, the marker attachment 45 is collapsed or closed over a rule or tape so that the tape is in-between the panels 46 and 47 and the hook formations 54 are hooked over their opposing edges 55 as shown in FIG. 6.

Figure 7:
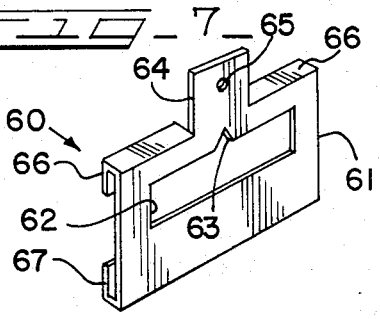
FIG. 7 is a perspective view of a fourth embodiment of the invention.
Figure 8:
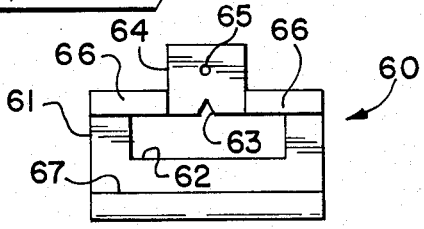
FIG. 8 is a front side view of the embodiment of FIG. 7.

In FIGS. 7 and 8, a marker attachment is indicated generally at 60 which is injection molded from suitable plastic material with one panel 61. The panel 61 has a window 62 formed therein with a V-pointer notch 63. An upstanding tab 64 is integrally formed at the top of the panel 61 and provided with a pencil-point receiving hole 65 in alignment with the V-pointer notch 63. Hook formations 66—66 are formed at the top edge of the panel 61 on opposite sides of the tab 64. A continuous hook formation 67 is formed on the bottom edge of the panel 61. It will be seen that, in use, the marker attachment 60 is applied to a rule or tape so that the opposing edges of the tape or rule will lie within the opposing hook formations 66 and 67. The dimensions of the marker attachment 60 should be such that the hook formations have a gripping or frictional engagement with the tape or rule so that it can be slid or moved to the desirable location on the rule or tape but will tend to remain in the location to which it is positioned unless it is positively moved to a different location.

In FIGS. 9–12, still another embodiment of the invention is shown in the form of a marker attachment which is indicated generally at 70 and which is generally similar to the marker attachment 5 of FIGS. 1 and 2. The marker attachment 70 is likewise formed by die-cutting or stamping from flexible, relatively stiff or semi-rigid sheet stock and then creased so as to provide an intermediate or middle panel 71, an end panel 72 and a second end panel 73 which is substantially longer than the panel 72. A piece of sponge rubber or similar rubber-like resilient pad material 74 is adhered to the inner face of the intermediate or middle panel 71. A tab 75 is die-cut from the panel 72 so as to be attached to the middle panel 71 along the crease or hinge line 76. A V-pointer 77 is die-cut from the middle panel 71 and hinged at the crease line 76.

The panel 73 has a window 78 die-formed therein and in the outer end thereof a locking tab 80 is die-cut and takes the form of a trapezoid with the distal or free edge 81 thereof somewhat longer than the width of the tab 75.

The tab 75 is provided with a pencil-point receiving hole 82 which is registrable with a pencil-point receiving hole 83 in the panel 73. The marker attachment 70 is shown in one of its closed or collapsed positions or conditions in FIG. 11 in which the locking tab 81 fits over the tab 75 and retains it in its position overlying the panel 73. The pencil-point receiving holes 82 and 83 will be in registration.

In FIG. 12, the marker attachment is folded in a different manner which is similar to that shown for marker attachment 5 in FIG. 14. The distal end of the tab 75 is passed through the window 78 in panel 73 and the locking tab 81 rests on the tab 75. The pencil-point receiving holes 82 and 83 will be in registration.

What I claim as new is:

1. A marker attachment for an elongated rule or tape comprising a piece of flexible plastic sheet material formed into at least two panels integrally hinged along a hinge line and foldable over opposite sides of an elongated rule, said panels having integral tab-like projections on their distal ends with registering pencil-point receiving holes therein, and hook means integrally formed on the distal end of one of said panels for retaining said panels in their folded condition with said holes in registration, at least one of said panels having a window therein for viewing markings on said rule or tape.

2. A marker attachment for an elongated rule or tape comprising a piece of flexible plastic sheet material formed into at least two panels integrally hinged along a hinge line and foldable over opposite sides of an elongated rule, said panels having integral tab-like projections on their distal ends with registering pencil-point receiving holes therein, one of said tab-like projections has at least one retention prong integrally projecting therefrom toward the other of said tab-like projections, and said other of said tab-like projections has a prong-receiving hole therein for corresponding to each of said retention prongs, at least one of said panels having a window therein for viewing markings on said rule or tape.

3. A marker attachment for an elongated rule or tape comprising a piece of semi-rigid plastic sheet material formed into three panels one being a middle panel, another panel being a first end panel integrally hinged to one of two parallel edges on opposite sides of said middle panel, and the remaining panel being a second end panel integrally hinged to the other of said two parallel edges of said middle panel, said first of said end panels having a length permitting it to overlap said middle panel and having a tab integrally formed from the material thereof and which remains attached to said middle panel by an intermediate portion of the hinge integrally interconnecting said first end panel and said middle panel, said second end panel having a length greater than the length of each of said first end panel and said middle panel so as to have a projecting portion when said piece of flexible sheet material is wrapped around an elongated rule, said second end panel having a window opening therein through which said tab may be inserted and then folded back over onto said projecting portion of said second end panel, and said tab and said projecting portion each having a pencil-point receiving hole therein which holes are in registration when said tab is folded over onto said projecting portion of said second panel.

4. The marker attachment of claim 3 wherein a piece of resilient rubber-like material is carried on a side of said middle panel so as to have frictional engagement with the confronting adjacent side of an elongated rule and thereby resist sliding movement of said marker attachment except when positively moved therealong.

5. The marker attachment of claim 3 wherein said middle panel has an integrally formed pointer projecting from said intermediate portion of the hinge integrally interconnecting said first end panel and said middle panel, said pointer being aligned with said pencil-point receiving holes.

6. The marker attachment of claim 3 wherein said tab bends around one edge of said window opening and said window opening has tab-receiving notches therein at opposite ends of said one edge of said window opening.

7. The marker attachment of claim 6 wherein said tab has a width greater than the width of said window opening but not great enough to prevent it from fitting into said tab-receiving notches.

8. The marker attachment of claim 3 wherein said projecting portion of said second end panel has a distal end portion from which a trapezoidal locking tang is formed leaving a trapezoidal opening in said distal portion through which tab may be inserted and for locking engagement with said distal portion.

* * * * *